United States Patent [19]

Maack et al.

[11] Patent Number: 4,521,960

[45] Date of Patent: Jun. 11, 1985

[54] APPARATUS FOR TERMINATING FLAT FLEXIBLE CABLES

[75] Inventors: Werner Maack, Seeheim; Richard Zendler, Erbach, both of Fed. Rep. of Germany

[73] Assignee: AMP Incorporated, Harrisburg, Pa.

[21] Appl. No.: 509,545

[22] Filed: Jun. 30, 1983

[30] Foreign Application Priority Data

Jul. 2, 1982 [GB] United Kingdom ..... 8219129

[51] Int. Cl.[3] ..... H01R 43/04

[52] U.S. Cl. ..... 29/749; 29/861

[58] Field of Search ..... 29/749, 750, 566.3, 29/861, 857, 879, 56.6, 564.6; 339/17 F

[56] References Cited

U.S. PATENT DOCUMENTS 4,228,709 10/1980 Guzay, Jr. et al. ..... 29/564.6 X
4,275,495 6/1981 Boutcher, Jr. et al. ..... 29/861 X
4,281,442 8/1981 Senior et al. ..... 29/857 X
4,290,179 9/1981 Bakermans ..... 29/749 X
4,351,110 9/1982 Folk ..... 29/749

*Primary Examiner*—Howard N. Goldberg
*Assistant Examiner*—Carl J. Arbes

[57] ABSTRACT

Apparatus for terminating a flat flexible cable comprises an anvil supporting an electrical connector, and a punch for driving the conductors of a flat flexible cable into conductor-relieving slots in individual terminals of the connector. Upon the cable end engaging a stop, a cable notching jaw is closed against a fixed cable notching jaw, to form notches between the conductors of the cable and the jaws are then retracted to allow the punch and the anvil to be moved towards one another to terminate the cable end to the terminals of the connector. The jaws are then returned so that the forward end thereof ejects the terminated connector from between the punch and anvil which have now been moved away from one another to allow this.

8 Claims, 11 Drawing Figures

FIG.3.
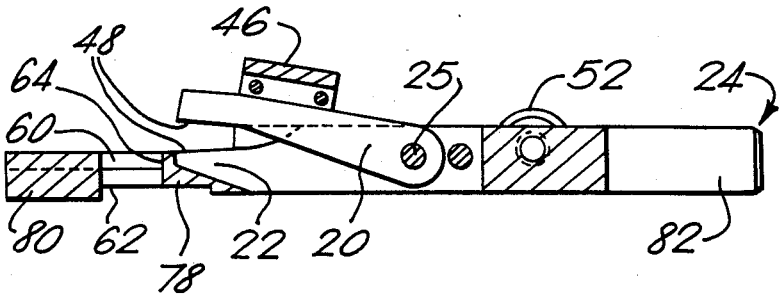
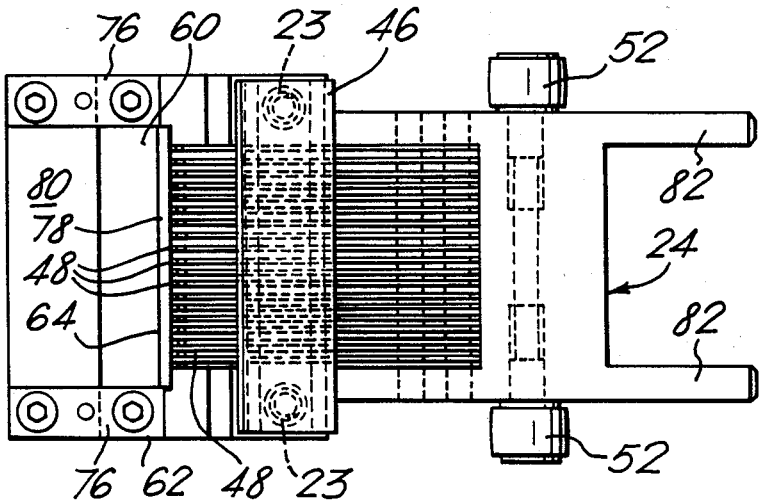
FIG.4.

APPARATUS FOR TERMINATING FLAT FLEXIBLE CABLES

This invention relates to apparatus for, and a method of, terminating flat flexible cables.

Apparatus for inserting the conductors of an end portion of a flat flexible cable into conductor-receiving portions of electrical terminals of an electrical connector, may comprise a connector supporting anvil, a conductor insertion punch and means for driving the punch from a retracted position through a working stroke towards the anvil to insert the conductors of the cable end portion when inserted between the punch and the connector, when the latter is supported on the anvil, into the conductor-receiving portions, and for subsequently driving the punch through a return stroke away from the anvil.

Since the insulation between the conductors of a flat flexible cable tends to inhibit the insertion of the conductors into the conductor-receiving portions of the terminals as well as to cause undue expansion of the conductor-receiving portions so as unacceptably to stress the usual barrier walls of the connector housing, which are provided between the terminals (this being especially the case where the terminals are closely spaced), it is common practice for the operator to notch the insulation between the conductors at the end portion of the cable by means of a cable notching tool, before introducing the cable end portion between the punch and the connector.

According to one aspect of the invention, the apparatus further comprises a pair of cable notching jaws, means for translating the jaws between a first position in which they lie between the punch and the anvil, with the punch in its retracted position, and a second position in which the jaws are retracted from between the punch and the anvil, means for moving the anvil between a first position in which the connector is displaced from the path of movement of the jaws when the jaws are in their first position and a second position in which the connector intersects the path of movement of the jaws when the jaws are in their second position, means for retaining the jaws in an open position when the jaws are in their first position and means for closing the jaws about the cable end prior to the translation of the jaws from their first to their second position; the apparatus being so arranged that subsequently to the insertion of the conductors into the conductor-receiving portions, the jaws are returned from their second to their first position, and the punch is driven through its return stroke to allow the connector to be ejected from between the punch and the anvil by the return movement of the jaws.

An abutment surface on the jaws may be arranged to act directly against the connector to eject it.

Conveniently, the punch, the anvil and the jaws are all actuated by the movement of a common plunger.

Also, conveniently, the punch, the anvil and the means for closing the jaws, may be connected to bell cranks pivoted to the frame and carrying the cam followers for co-operation with cam surfaces on the plunger.

According to another aspect thereof the invention provides a method for inserting the conductors of an end portion of a flat flexible cable into conductor-receiving portions of electrical terminals of an electrical connector, in which method a punch is advanced towards an anvil supporting the connector, to insert the conductors into the conductor-receiving portions; wherein, prior to the insertion of the conductors into the conductor-receiving portions, a cable notching tool which has been inserted between the punch and the connector with the anvil positioned so that the connector is displaced from the path of the tool, is employed to divide the insulation between the conductors of the cable end portion, after which the tool is retracted from between the punch and the connector, the anvil is moved to place the connector in the path of the tool and the tool is advanced to eject the connector from between the punch and the anvil.

For a better understanding of the invention, an embodiment thereof will now be described by way of example with reference to the accompanying drawings, which are diagrammatic, and in which:

FIG. 3 is a longitudinal sectional view through a jaw carriage of the apparatus;

FIG. 4 is a plan view of the jaw carriage;

The apparatus and its operation will now be described in outline.

Figure 1:
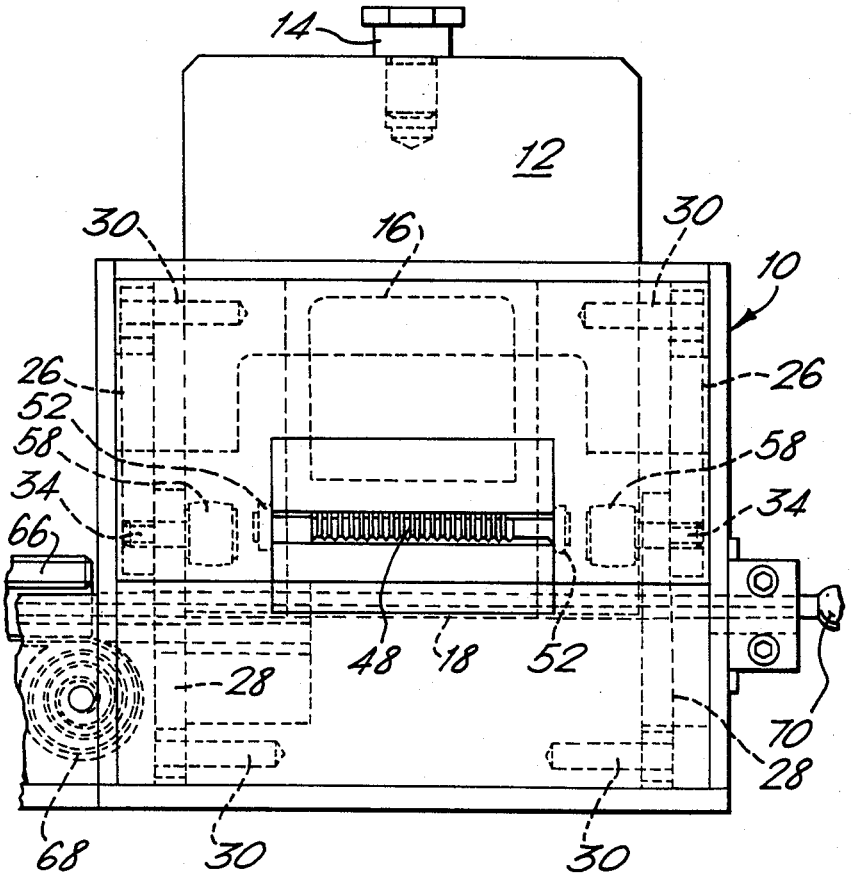
FIG. 1 is a front view of apparatus for notching end portions of flat flexible cables and for inserting the conductors of the cables into conductor-receiving portions of terminals of electrical connectors.
Figure 2:
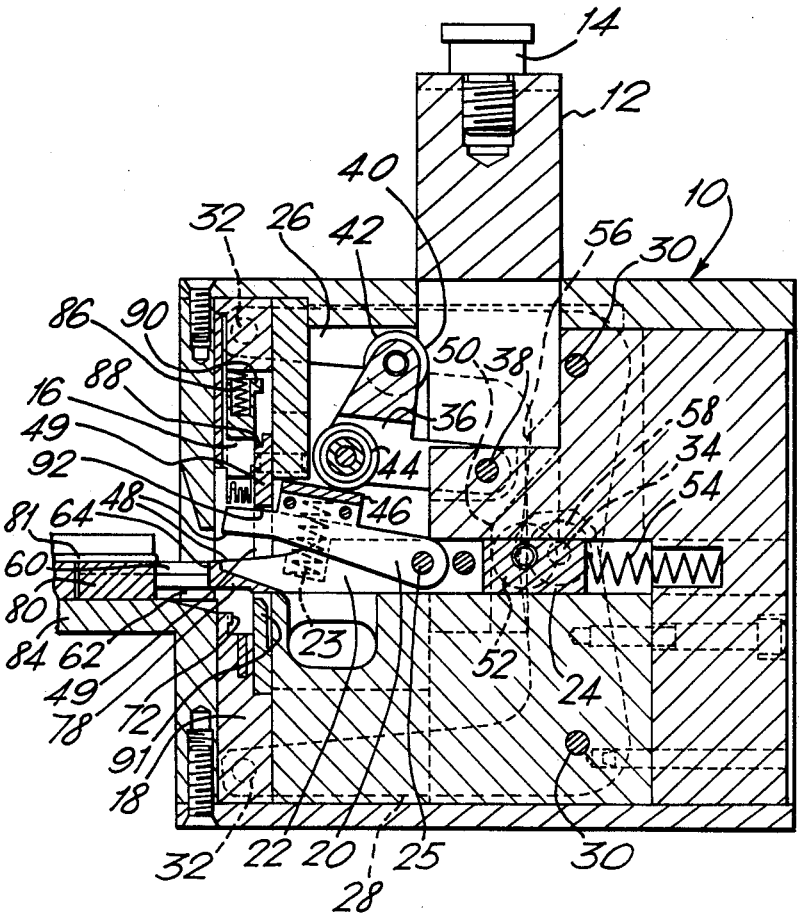
FIG. 2 is a sectional side view of the apparatus.

As shown in FIGS. 1 and 2, the apparatus comprises a frame 10 in which a plunger 12 having an adaptor 14 for connection to a press ram (not shown) is mounted for vertical reciprocating movement.

Also mounted for vertical reciprocating movement in the frame 10, are a conductor insertion punch 16 and a connector supporting anvil 18.

Cable notching jaws 20 and 22, urged towards an open position by return springs 23 are attached to a jaw carriage 24 which is slidable horizontally in the frame 10, the jaw 20 being swingable about a pin 25 with respect to the jaw 22 which is fixed with respect to the carriage 24.

Bell cranks 26 and 28, pivoted to the frame 10 on pins 30, are pivotally connected to the punch 16 and to the anvil 18, respectively, by means of pins 32, the cranks 26 and 28 being pivotally interconnected by means of pins 34.

A jaw actuating bell crank is pivoted to the frame 10 on a pin 38.

Figure 5A:
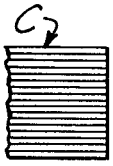
FIG. 5A is a plan view of the cable end portion shown in FIG. 5.
Figure 5:
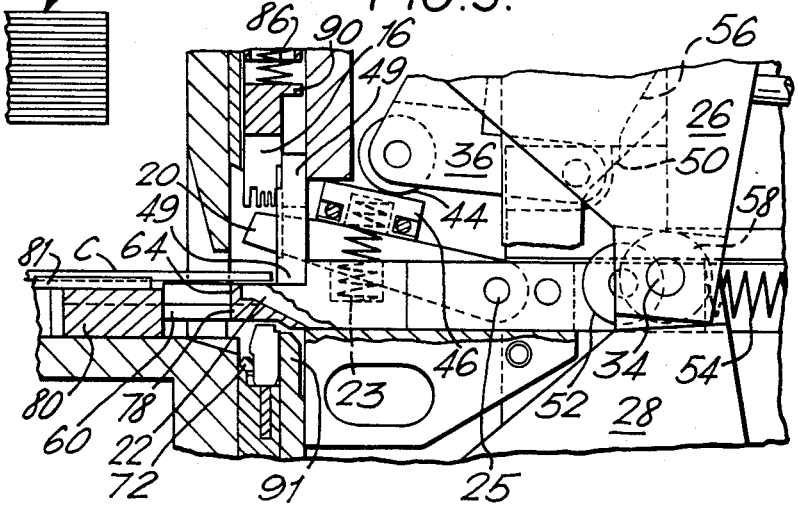
FIG. 5 is a fragmentary sectional side view of the apparatus in a starting position, after an end portion of a flat flexible cable has been inserted into the apparatus.

When the end portion C of a flat flexible cable, best seen in FIG. 5A, has been inserted between the jaws 20 and 22 to an extent limited by a stop plate 49 as shown in FIG. 5, the plunger 12 is depressed, through a working stroke, from the raised position in which it is shown in FIGS. 2 and 3. A first cam surface 40 on the plunger 12 acts against a first roller 42 on the crank 36 to cause a second roller 44 thereon to depress a cam plate 46 on the jaw 20 thereby to close it against the jaw 22, so that rows of cable notching blades 48 (best seen in FIG. 4) on the jaws 20 and 22 pierce the insulation of the cable C between its conductors 8.

Figure 6A:
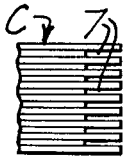
FIG. 6A is a plan view of the notched cable end portion.
Figure 6:
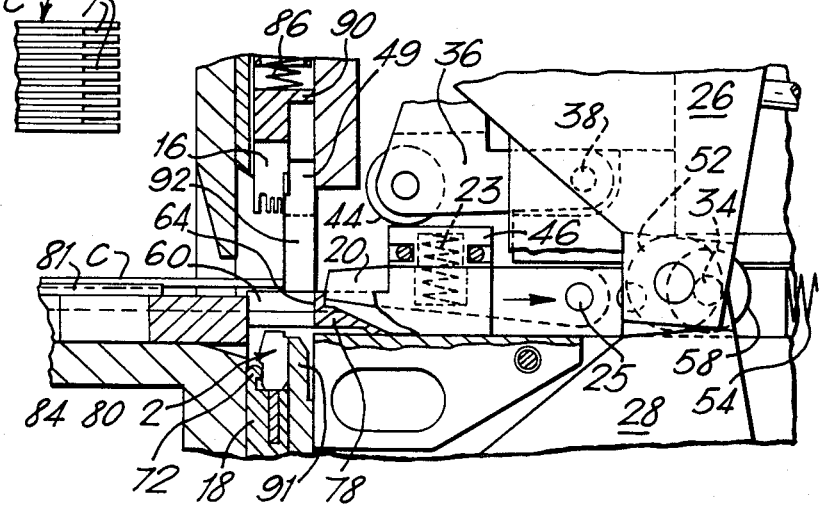
FIG. 6 is a similar view to FIG. 5 but showing the apparatus after having formed notches in the cable end portion.

As the plunger 12 continues to descend through its working stroke, a second cam surface 50 thereon strike rollers 52 on the jaw carriage 24 so as to retract the closed jaws 20 and 22, as shown in FIG. 6, from between the punch 16 and the anvil 18, against the action of a jaw carriage return spring 54, whereby notches 7 (FIG. 6A) are formed in the cable end portion C to separate the conductors thereof. The cable stop plate 49 prevents the cable C from being dragged along with the jaws 20 and 22 during their retractile movement.

Figure 7A:
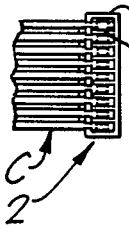
FIG. 7A is a plan view of the cable end portion when so terminated.

Upon further descent of the plunger 12, to its bottom position, third cam surfaces 56 thereon engage rollers 58 on the pins 34 to swing the bell cranks 26 and 28 about the pins 30 so that the punch 16 and the anvil 18 are driven towards one another, whereby each separated conductor of the cable end portion C is inserted into the appropriate conductor-receiving slot of a slotted plate electrical terminal 6 of an electrical connector 2 according to the teaching, for example of U.S. Pat. No. 4,159,158, on the anvil 18 by means of the punch 16 (see FIGS. 7 and 7A). A row of the terminals 6 are supported lin an insulating housing 4 of the connector 2.

The plunger 12 now ascends through a return stroke to its initial position, the carriage 24 being returned by the spring 54 and the bell cranks 26 and 28 being returned by further springs (not shown). The bell crank 36 is returned by the cam plate 46 as the jaw 20 is raised by the springs 23.

Figure 7:
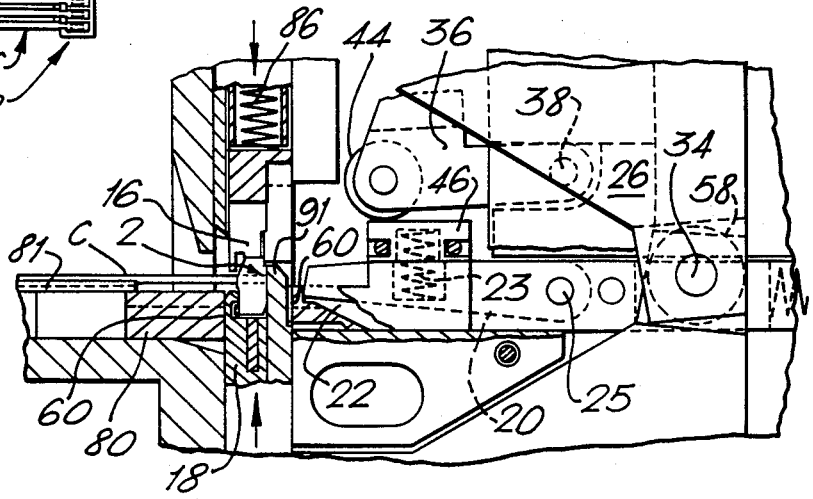
FIG. 7 is a similar view to that of FIG. 6 but showing the apparatus after having terminated the notched cable end portion to an electrical connector.

The connector 2, which is now attached to the cable C, does not fall with the anvil 18 but remains suspended by the cable C in an opening 60 (best seen in FIG. 3) in the forward part 62 of the jaw carriage 24, which opening is aligned with the punch 16 and the anvil 18 in the FIG. 7 position of the carriage 24. The springs 23 are not shown in FIG. 3.

Figure 8:
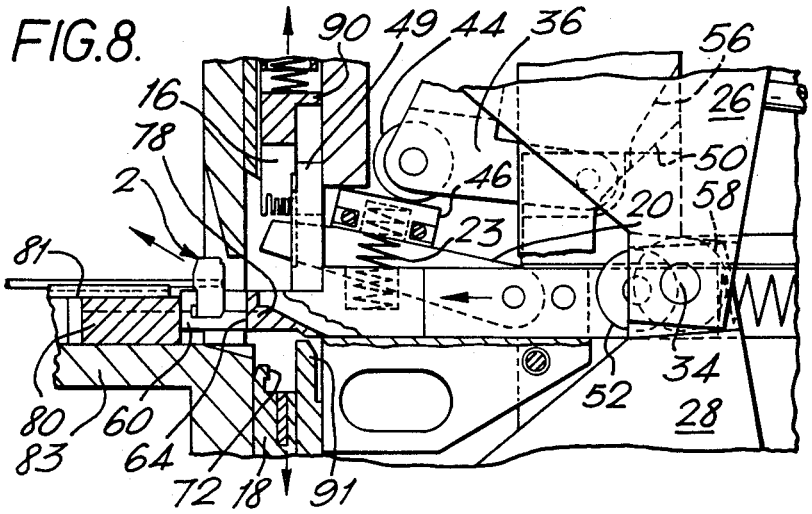
FIG. 8 is a similar view to that of FIG. 7, but showing the connector positioned so as to be removable from the apparatus.

By virtue of the relative positions of the cam surfaces 50 and 56, the jaws 20 and 22 begin to return as the punch 16 and the anvil 18 start to move away from one another, so that the connector 12 is pushed from the anvil 18 by a wall 64 of the hole 60, adjacent to the jaw 22. The cable C with the connector 2 thereon can now be removed by the operator (see FIG. 8).

The apparatus will now be further described.

A column of connectors 2 to be wired is fed towards the anvil 18 along a magazine 66 (FIG. 1) by means of a feed plate (not shown) connected to a coil spring 68, the position of the feed plate axially of the magazine 66 being adjustable by means of a knob 70 to allow for connector length. Each connector 2 is guided in the anvil 18 by means of an axial flange 72 therein, which engages the housing of the connector 2.

As best seen in FIGS. 3 and 4, the opening 60 in the carriage 24 is defined between a pair of arms 76 projecting forwardly of the jaw 22, a short forward extension 78 of that jaw and a jaw carriage guide block 80 spanning the arms 76 at the extreme forward end of the carriage 24 and adapted to be received between a cable rest 81 and an extension 82 of the frame 10, as shown in FIGS. 2, and 5 to 8. The spring 54 is received between arms 82 at the rear end of the carriage 24.

When the cable end portion C is to be introduced between the punch 16 and the connector 2 on the anvil 18, the portion C is laid on the cable rest 81 and is advanced by the operator axially towards the stop plate 49. The stop plate 49 is provided with a limit switch (not shown) arranged to initiate a cycle of the press and thus a working and a return stroke of the plunger 12 when the limit switch is engaged by the extremity of a cable end portion C.

The jaws 20 and 22 are guided during their translatory movement by the edges of a hole 92 in the stop plate 49.

As will be apparent from FIG. 2, one pair of bell cranks 26 and 28 is positioned on either side of the carriage 24. The carriage having a roller 52 on either side. The plunger 12 accordingly has a cam surface 50 and a cam surface 56 on either side of the carriage 24.

For use with the connectors into the terminals of which the cable conductors must be inserted first under a low insertion force and subsequently under a higher insertion force, the punch 16 may, as shown, be connected to the bell crank 26 via a spring 86 against the action of which the punch 16 exerts the lower insertion force. The movement of the punch 16 and anvil 18 towards one another is limited by the engagement of a stop surface 88 on the stop plate 49 with a stop 90 on the punch 16, as the stop plate 49 is raised by an abutment 91 on the anvil 18 (see FIG. 7).

During their translatory movement, the jaws 20 and 22 are guided by the walls of an opening 92 in the stop plate 49.

The embodiments of the invention for which an exclusive property or priviledge is claimed are as follows:

1. Apparatus for inserting the conductors of an end portion of a flat flexible cable into conductor-receiving portions of electrical terminals of an electrical connector, the apparatus comprising a connector supporting anvil, a conductor insertion punch for moving conductors aligned with the terminals laterally of their axes and into the conductor-receiving portions, and first actuator means for driving the punch from a retracted position through a working stroke towards the anvil to insert the conductors of the cable which has been positioned between the punch and a connector supported on the anvil into the conductor-receiving portions, the first actuator means being effective subsequently to drive the punch through a return stroke away from the anvil, the apparatus further comprising a pair of cable notching jaws, second actuator means operatively associated with said first actuator means for moving the jaws along a path of movement between a first position in which they lie between the punch and the anvil, when the punch is in its retracted position, and a second position in which the jaws are retracted from between the punch and the anvil, third actuator means operatively associated with said first and second actuator means for moving the anvil between a first position in which a connector supported thereon is displaced from the path of movement of the jaws when the jaws are in their first position and a second position in which the connector intersects the path of movement of the jaws when the jaws are in their second position, jaw opening and closing means operatively associated with said first, second and third actuator means for retaining the jaws in an open position when the jaws are in their first position and for closing the jaws about the cable end prior to the movement of the jaws from their first to their second position; the first, second and third actuator means being timed so that subsequently to the insertion of the conductors into the conductor-receiving portions, the jaws are returned from their second to their first position, and the punch is driven through its return stroke to allow the connector to be ejected from between the punch and the anvil.

2. Apparatus according to claim 1, wherein one of the jaws is provided with an abutment surface for engaging the connector to eject it from between the punch and the anvil when the jaws are moved along the path of movement from the second position to the first position.

3. Apparatus according to claim 2, wherein the one jaw has an opening which receives the connector when the jaws are in their second position, the abutment surface constituting a wall of the opening, a guide member attached on the anvil on the opposite side of the opening to the one jaw being slidable beneath a cable rest said cable rest being attached to a frame of the apparatus.

4. Apparatus according to claim 1, wherein the first, second and third actuator means comprises a plunger having a punch driving cam surface for driving the punch through its working stroke and for moving the anvil from its first to its second position, having a jaw moving cam surface for moving the jaws from their first to their second position and having a jaw closing cam surface for closing the jaws, the cam surfaces acting sequentially during a working stroke of the plunger.

5. Apparatus according to claim 4, wherein the punch and the anvil are mounted on opposed bell cranks connected by a pivot provided with a cam follower for co-operation with the punch driving cam surface.

6. Apparatus according to claims 4 or 5, wherein the jaws are slidable from their first to their second position against the action of a spring with said spring attached between the jaws and a frame and one of the jaws carry a cam follower for co-operation with the jaw moving cam surface, and the other one of the jaws being fixed to the one of the jaws which has a surface for co-operation with a roller and the roller being pivotably attached to a further bell crank which is pivotably attached to a frame and which carries a cam follower for co-operation with the jaw closing cam surface.

7. Apparatus according to any one of claims 1, 2 or 3, wherein a cable stop member is provided, the cable stop member being drivable by the anvil towards the punch and has an opening the walls of which serve to guide the jaws during their movement, and has a stop surface for co-operation with a stop on the punch to limit movement of the punch and the anvil towards one another.

8. Apparatus according to claim 1, wherein the jaws are mounted on a jaw carriage movably attached to a frame, with the jaw carriage being movable at right angles to the path of movement of the punch and the anvil and from which extends a jaw carriage guide member which lies beyond such path in the first position of the jaws, the carriage having an opening between the guide member and the jaws, which receives the connector when the jaws are in their second position and as the anvil is moved towards its second position, an edge of the opening adjacent to the jaws engaging the connector as the jaws are returned towards their first position.

* * * * *